United States Patent [19]

Shallenberg et al.

[11] Patent Number: 4,981,226

[45] Date of Patent: Jan. 1, 1991

[54] MERCHANDISE DISPLAY ASSEMBLY

[76] Inventors: Robert L. Shallenberg, 1460 Gulf Blvd., #503, Clearwater, Fla. 34630; Robert H. Shallenberg, 240 W. Lake St., Barrington, Ill. 60010

[21] Appl. No.: 514,925

[22] Filed: Apr. 26, 1990

[51] Int. Cl.[5] ..... A47F 5/00

[52] U.S. Cl. ..... 211/189; 108/111; 211/187

[58] Field of Search ..... 211/189, 187, 133, 186; 108/111

[56] References Cited

U.S. PATENT DOCUMENTS

| | | | |
|---|---|---|---|
| 4,262,439 | 4/1981 | Dinan et al. | 211/187 X |
| 4,344,367 | 8/1982 | Merl | 211/187 X |
| 4,531,646 | 7/1985 | Howard | 211/59.2 X |
| 4,633,788 | 1/1987 | Robertson | 211/189 X |
| 4,771,898 | 9/1988 | Howard et al. | 211/133 X |

*Primary Examiner*—Robert W. Gibson, Jr.
*Attorney, Agent, or Firm*—Rockey and Rifkin

[57] ABSTRACT

The present invention is generally directed to a merchandise display assembly for use in retail stores and, more particularly, to a display unit which is easy to assemble, attractive in appearance and low in cost to manufacture and use. The present invention provides a display unit containing a base structure, canopy structure and slotted tubing for vertical placement between said base and canopy structures, with the base and canopy structures being made of wood, or other materials, and containing metal sockets for receipt of the respective ends of the vertical tubes. The metal sockets are installed in both the base and canopy structures in precise spatial relationships to provide for vertical alignment of the base and canopy structures when the tubes are inserted into the corresponding metal sockets on the base and canopy structures. Usually four tubes of equal dimensions are used, requiring four metal sockets in the base structure and four metal sockets on the canopy structure. The metal sockets are precisely spaced and designed to matingly receive the respective ends of the tubes to require no tools for assembly by the end user.

16 Claims, 4 Drawing Sheets

FIG. 2
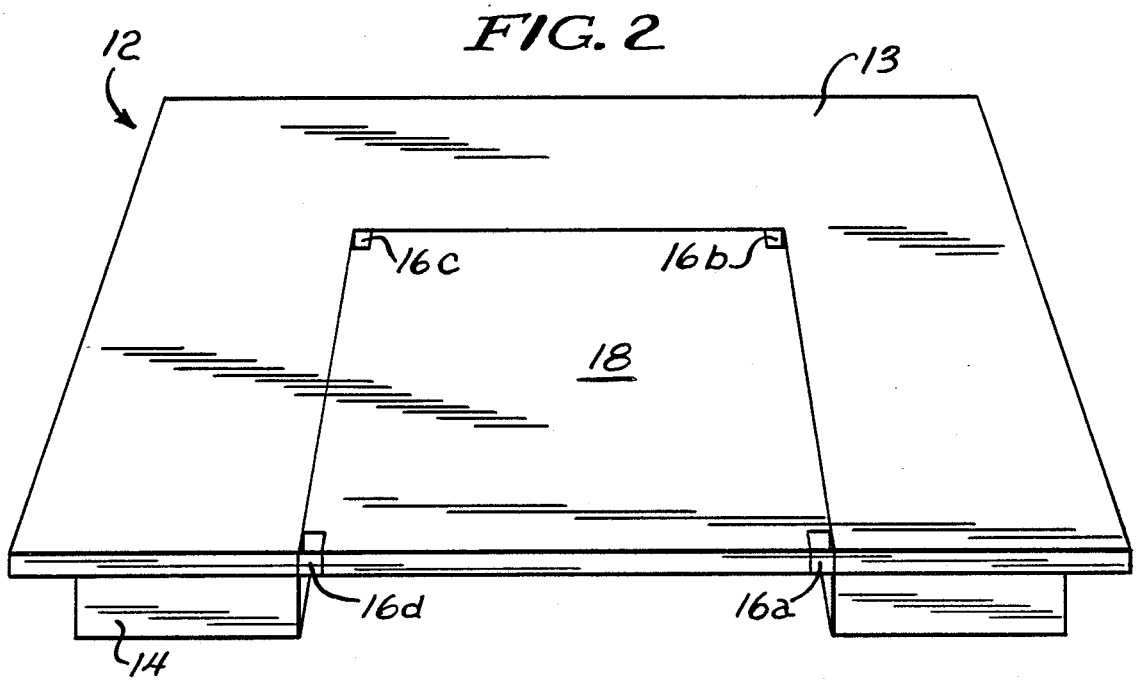
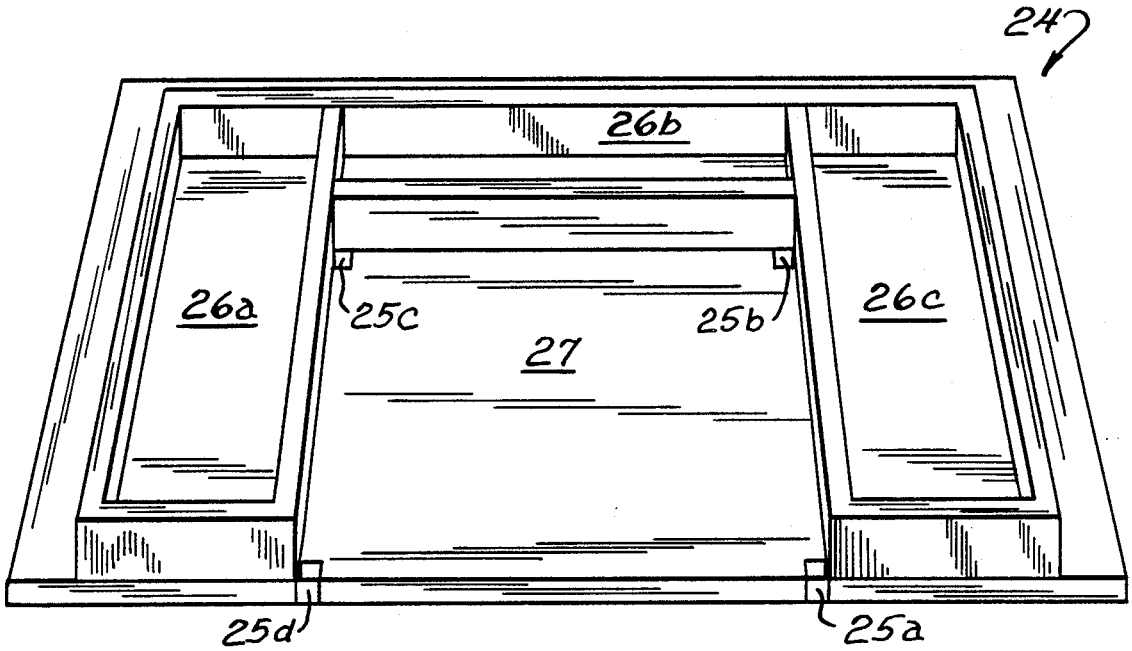
FIG. 3

FIG. 4
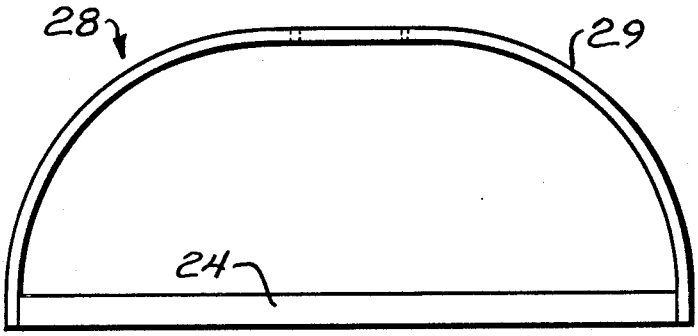
FIG. 5
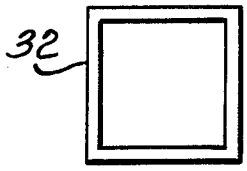
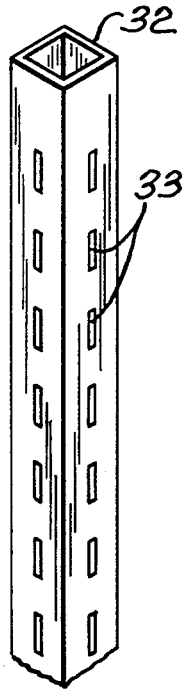
FIG. 6
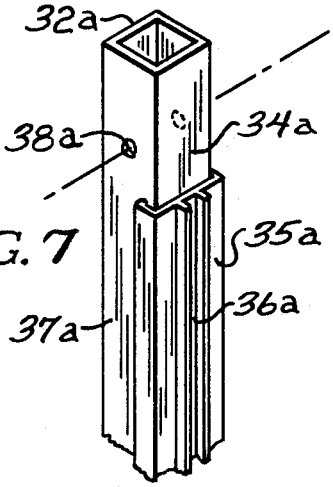
FIG. 7
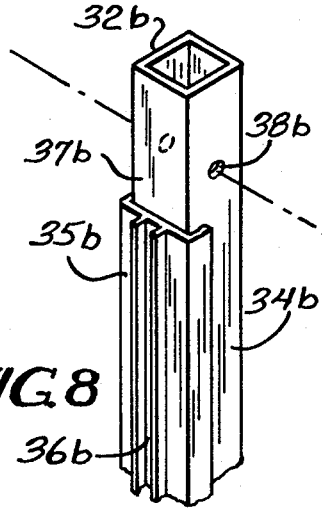
FIG. 8
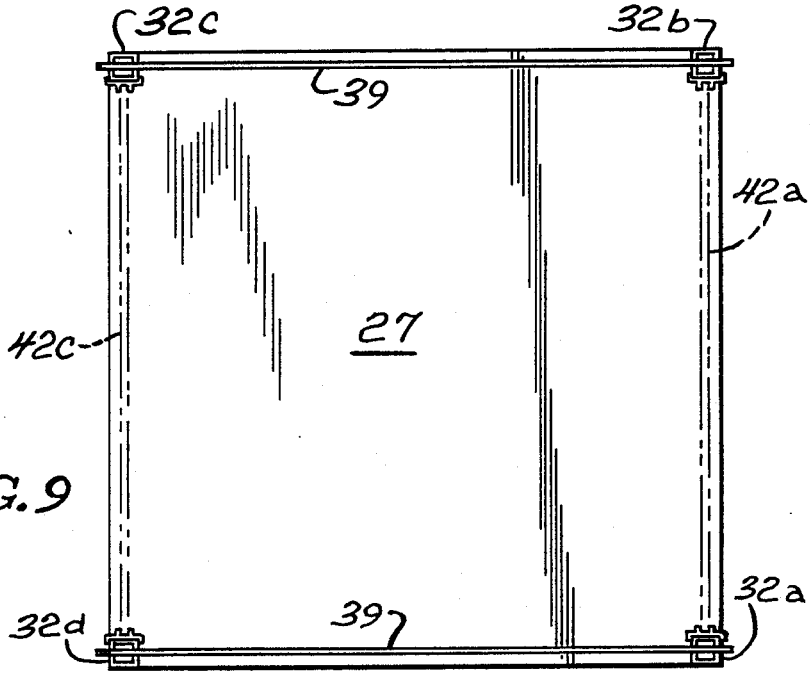
FIG. 9

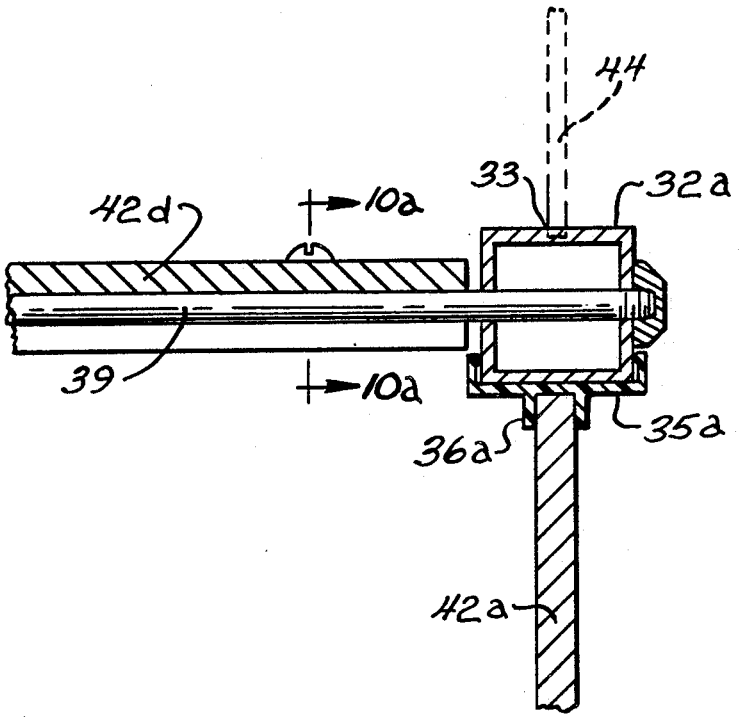
FIG. 10
FIG. 10a
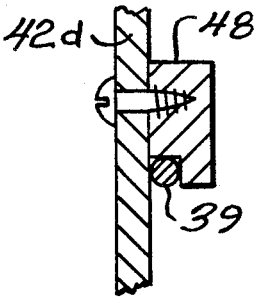
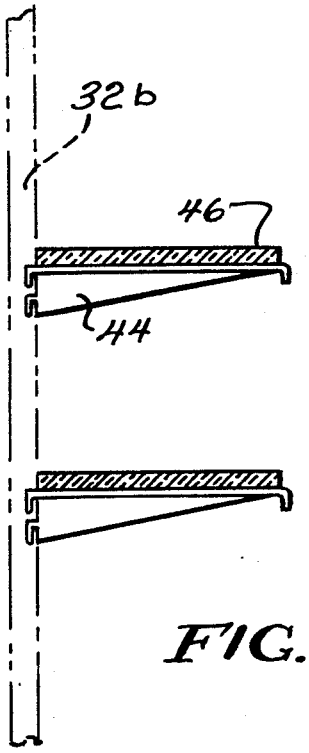
FIG. 11

MERCHANDISE DISPLAY ASSEMBLY

BACKGROUND OF THE INVENTION

This invention relates generally to merchandise display assemblies used in retail stores and, more particularly, to a merchandise display unit having a design which provides the end-user retail store with a display structure which is easy to assemble and attractive in appearance.

As customers who frequent retail stores can attest, display structures for merchandise come in all shapes and sizes, ranging from simple racks for hanging clothes to shelves to free-standing shelf units to bins to stackable bins t rotating units to complicated, suspended-from-the-ceiling arrangements. Examples of such structures are disclosed in U.S. Pat. Nos. 4,813,553; 4,706,824; 4,444,322; 4,450,775; 4,534,473; 4,697,712; and 4,242,970. Other structures, such as shelf units for home use, or rack systems for the storage of food or goods are also known, and examples of those are disclosed in U.S. Pat. Nos. 3,724,678; 3,468,430; and 3,411,634. The appearance and complexity of assembly of such structures vary, depending at least in part upon their intended uses and design characteristics.

In the design and manufacture of merchandise display units for retail stores, there are specific considerations which must be taken into account. The considerations include, among others: the overall structural design of the display unit which is determined, in large part by the type of merchandise displayed; the structural strength of the unit which, in the retail setting, must take into account the volume of customer traffic; the complexity of assembling the unit by end-users who are, for the most part, not particularly mechanically minded; the placement of the unit, namely whether it is a free-standing unit, a wall-supported unit or end-of-the-aisle unit; the flexibility of placement and movement of the unit; the appearance of the unit, that is, whether the unit and the merchandise displayed attract the attention of customers; and, the cost of the unit. While some of the patents referenced above address these considerations, improved display units, especially units which are easy to assemble, attractive in appearance and low in cost, are still needed.

The display unit of the present invention was designed with the above-mentioned considerations in mind, and provides an improved merchandise display unit to fulfill those needs.

SUMMARY OF THE INVENTION

The present invention is generally directed to a merchandise display assembly for use in retail stores and, more particularly, to a display unit which is easy to assemble, attractive in appearance and low in cost to manufacture and use. The present invention provides a display unit containing a base structure, canopy structure and slotted tubing for vertical placement between said base and canopy structures, with the base and canopy structures being made of wood, or other materials, and containing metal sockets for receipt of the respective ends of the vertical tubes. The metal sockets are installed in both the base and canopy structures in precise spatial relationships to provide for vertical alignment of the base and canopy structures when the tubes are inserted into the corresponding metal sockets on the base and canopy structures. Usually four tubes of equal dimensions are used, requiring four metal sockets in the base structure and four metal sockets on the canopy structure. The metal sockets are precisely spaced and designed to matingly receive the respective ends of the tubes to require no tools for assembly by the end user.

Preferably, the tubes and metal sockets are square or rectangular in cross-section, with the respective cross-sections of the metal sockets being slightly larger than that of the tubes to allow the ends of the tubes to slide into the sockets. The usual display unit requires four tubes of equal length; thus, four metal sockets on the base structure and four metal sockets on the canopy structure are required. In addition, each tube is preferably provided with slots on two adjacent faces of the tube, to allow for the mounting of shelf brackets for placement of the shelving; one other face of each tube is provided with plastic extrusion, or cladding, along its length to allow for placement of some of the backing supports, usually pegboard material, for the display unit; the remaining face of each tube may be solid. Each vertical tube is further provided with holes at both ends, extending through the blank face and the opposite slotted face, to allow for placement of tie rods between adjacent tubes for placement of the remaining backing supports and also as a further anchoring means for the display unit.

Each element of the display unit, namely the base and canopy structures, the tubes, tie rods, backing supports, shelf brackets and shelving are either manufactured or purchased with the precise dimensions of the unit in mind. After a unit is completed, it is shipped, unassembled, to the end user, usually a retail store. At the store, the unit can be easily assembled, without tools, in the following manner: the base structure is placed in the desired location; the end of each vertical metal tube is placed in a metal socket with the slotted faces directed to the exterior of the unit, and positioned so that the blank face of each tube is directed toward the blank face of an adjacent tube and the face with cladding on each tube is directed toward the face with cladding on an adjacent tube; tie rods are installed between two pairs of adjacent tubes through the blank faces; temporary assembly gages, for further stability, may be installed between the two pairs of adjacent tubes in which the cladded faces are directed toward each other; pegboards or backing supports are placed between the two pairs of tubes with cladding and slipped into position in the cladding; pegboards or backing supports with hanging or hooking means are placed between the two pairs of vertical tubes connected by the tie rods and are hung or hooked over the tie rods; the canopy structure is placed on the top ends of the metal tubes; the temporary assembly gages are removed; the shelf brackets are inserted into the slots on the metal tubes; and the shelves are then placed on the brackets. As can be seen, the entire unit is assembled by the end user without any tools at all.

The primary object of this invention, therefore, is to provide an improved merchandise display unit with a novel structure which allows for easy assembly of the unit by the end user.

Another object of this invention is to provide a merchandise display unit which includes base and canopy structures which are manufactured to include metal sockets mounted in precise spatial relation to allow for ease of assembly of the entire unit by an end user.

A further object of this invention is to provide a merchandise display unit which, in addition to being easy to assemble, is economical to manufacture and therefore low in cost to the end user.

These objects and advantages, as well as others, will become apparent from the following description of the invention.

DESCRIPTION OF THE INVENTION

FIG. 1 is a perspective view of one of the embodiments of the merchandise display unit of the present invention;

FIG. 2 a plan view of the base structure of the merchandise display unit of FIG. 1;

FIG. 3 is a plan view of the lower support frame of the canopy structure of the merchandise display unit of FIG. 1;

FIG. 4 is a sectional side view of the canopy portion of the canopy structure of the merchandise display unit of FIG. 1;

Figure 1:
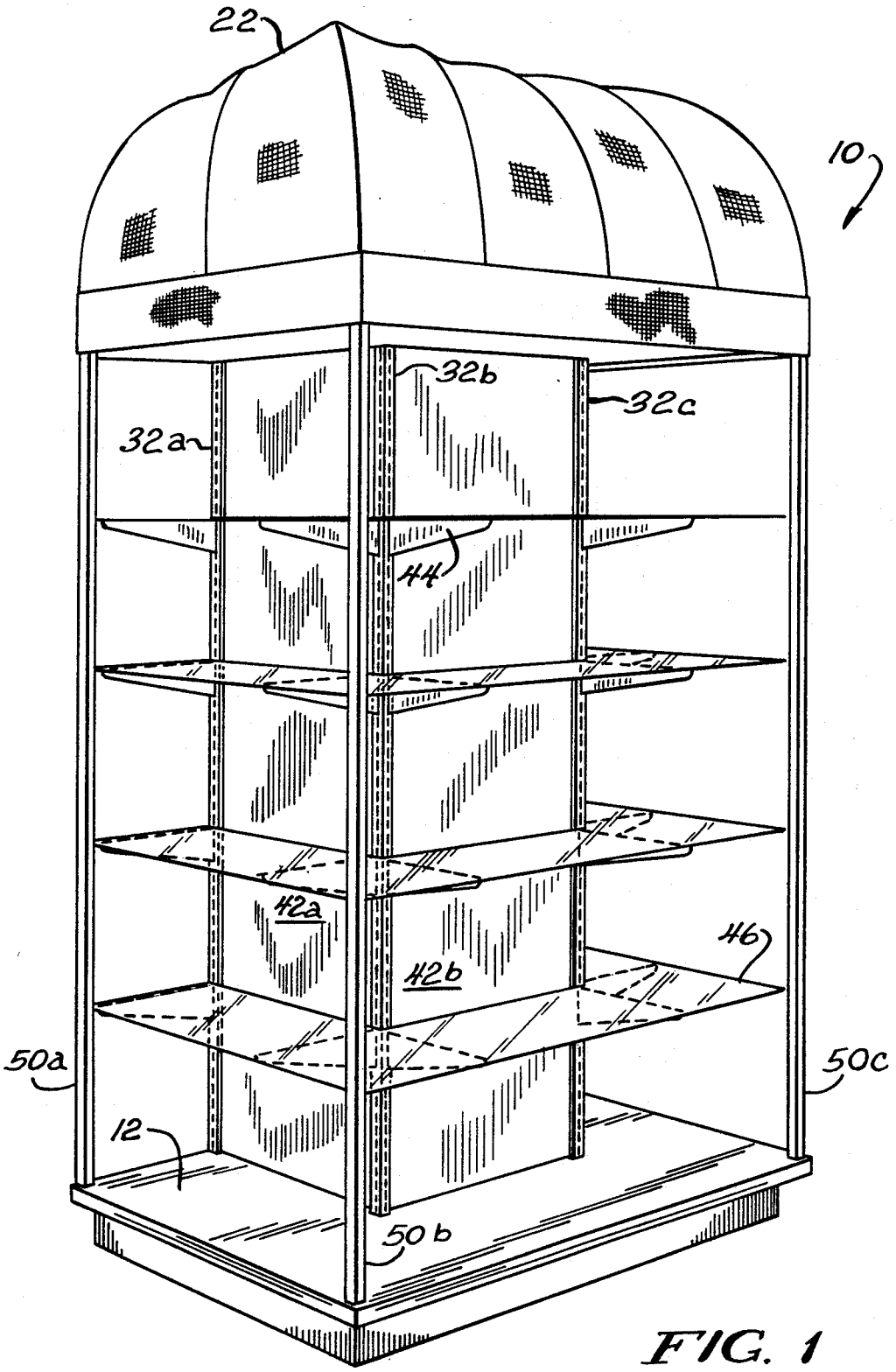

FIGS. 5, 6, 7 8 are exploded perspective views of portions of the vertical tubes used in the merchandise display unit, showing the general dimensions of the tubes, the slots on two adjacent faces, the plastic extrusion on another face and the holes for tie rods on the last face, respectively;

FIG. 9 is a cross-sectional view of the support column of the merchandise display unit after the vertical tubes, lower tie rods and two pieces of backing material have been installed in the base structure;

FIG. 10 is an exploded cross-sectional, underside view of vertical tube 32*a* as shown in FIG. 9 after all of the backing material has been installed;

FIG. 10*a* is a side view of FIG. 10 taken across line A—A; and

FIG. 11 is a sectional side view of the metal shelf brackets and shelves used in the merchandise display unit of the present invention.

DETAILED DESCRIPTION OF THE INVENTION

Referring now to the drawings, FIG. 1 illustrates the merchandise display unit of the present invention, generally identified by the numeral 10. The unit consists of a base structure 12, a canopy structure 22, a plurality of vertically oriented interior support tubes of which tubes 32*a*, 32*b* and 32*c* are exemplary, a plurality of pegboards or backing supports of which supports 42*a* and 42*b* are typical, a plurality of shelf brackets of which brackets 44*a* and 44*b* are exemplary, a plurality of shelves, of which shelves 46*a* and 46*b* are exemplary and, optionally, a plurality of vertically oriented exterior support tubes, of which tubes 50*a*, 50*b* and 50*c* are typical. Elements which are not seen in this figure include tubes 32*d* and 50*d* and backing supports 42*c* and 42*d*. The display unit shown generally in FIG. 1 is called an "end-of-the-aisle" unit, that is, one having shelves for displaying merchandise on three sides of the unit. The "stand-alone" unit, one with shelves on all four sides, is another embodiment of the present invention which is not shown but will be described later herein.

FIGS. 2 through 10 provide more details regarding the various components of the display unit 10 shown in FIG. 1. FIG. 2 shows the base structure 12 of the display unit 10 of FIG. 1; the base structure 12 has a platform section 13 which is generally rectangular in shape and elevated by means of a pedestal section 14. The exact dimensions of the platform section 13 are determined by the needs of the end user, with the preferred dimension being approximately 48 inches in width, 36 inches in depth and 1 inch thick; the pedestal section 14 is preferably 3 to 5 inches in height and somewhat shorter in length and width to provide a recessed lower portion of the base structure 12. The base structure 12 is preferably constructed from wood, although other materials may be used. The platform section 13 of base structure 12 is further provided with four metal sockets 16*a*, 16*b*, 16*c* and 16*d*, preferably mounted from below, with the metal sockets 16*a*, 16*b*, 16*c* and 16*d* being closed at the bottom and open at the top to allow for receipt of the ends of the tubing 32*a*, 32*b* and 32*c*, shown generally in FIG. 1, and tubing 32*d* (not shown).

As can be seen in FIG. 2, the metal sockets 16*a*, 16*b* and 16*c* are placed in the platform section 13 in precise spatial relationships to each other. Generally, in a base structure 12 for use as an end-of-the-aisle unit (as shown in FIG. 1), the metal sockets 16*a*, 16*b*, 16*c* and 16*d* are placed at the corners of a square section 18 which lies flush with one side of the base structure 12 and is set in approximately 12 inches from the other three sides. The dimensions of the square section 18, like the base structure 12, can vary depending upon the needs of the end user, but a square section 18 approximately 24 inches by 24 inches is the preferable size.

The dimensions of the metal sockets 16*a*, 16*b*, 16*c* and 16*d* shown in FIG. 2 can also vary depending upon the specific requirements of the end user; the exact dimensions are determined by the size of the tubes used. In general, if 1 inch by 1 inch tubes are used, the metal sockets would correspondingly be about the same 1 inch by 1 inch dimensions or slightly larger to allow for placement of the tubes in the sockets. The depth of the sockets, of course, may also vary, but for stability purposes, a depth of at least 1 inch is preferred.

As is also illustrated in FIG. 2, the metal sockets 16*a*, 16*b*, 16*c* and 16*d* are placed at the corners of square section 18; therefore, the distance between any two sockets on any side of the square 18 is precisely the same. To assemble the metal sockets 16*a*, 16*b*, 16*c* and 16*d* to obtain the precise spatial relationship required, a metal fixture having a 24-inch square frame is used. At each corner of the square frame, short lengths of the same tubing used for the vertical tubes, usually 1 inch by 1 inch, are mounted, each protruding the same distance, usually one inch, to simulate the "real" vertical tubes. The metal sockets 16*a*, 16*b*, 16*c* and 16*d* are placed over the protruding short lengths, the frame and metal sockets placed in the desired location on the base structure and the metal sockets are then secured to the base structure, preferably with two bolts each. The metal frame is removed, leaving the metal sockets 16*a*, 16*b*, 16*c* and 16*d* properly positioned.

If, instead of a square section 18, a rectangular section is used, the metal frame would be rectangular, and the distance between two sockets on one side (length or width) should be equal to the distance between the other two sockets on the corresponding side. The metal sockets 16*a*, 16*b*, 16*c* and 16*d* are positioned in the platform section 13 of base structure 12 in the same manner as described above, or by other methods known to those skilled in the art, including welding methods in the case of a metal base structure, to insure that the metal sockets are firmly in place.

The next component of the display unit 10 of FIG. 1, the canopy structure 22, is shown in more detail in FIGS. 3 and 4; FIG. 3 illustrates the lower canopy frame 24 of the canopy structure while FIG. 4 shows a cross-section view of the canopy top section 28 of the canopy structure 22 (FIG. 1). Referring first to FIG. 3, it can be seen that the canopy frame 24 of the canopy structure 22 corresponds to the platform section 13 of base structure 12 of FIG. 2, that is, the dimensions of canopy frame 24 are generally identical to those of the platform section 13. Therefore, the canopy frame 24 is generally rectangular in shape, with the preferred dimensions being approximately 48 inches by 36 inches by 4 inches. One difference between the canopy frame 24 and base structure 12 is that, except for the square section 27, the remaining areas 26*a*, 26*b* and 26*c* are empty, allowing for placement of light fixtures, if desired, in the final assembly.

Four metal sockets, 25*a*, 25*b*, 25*c* and 25*d* are positioned in the canopy frame 24 at the corners of the square section 27, which is preferably 24 inches by 24 inches, using the methods described above for positioning the metal sockets in the base structure. In this way, the precise spatial relationship between the metal sockets, and the precise spatial relationship between the base structure 12 and canopy frame 24 are attained. As further shown in FIG. 3, the metal sockets 25*a*, 25*b*, 25*c* and 25*d* are placed in the canopy frame 24 with the open faces of the sockets facing downward, so that the sockets may receive the other ends of the tubes placed in the corresponding sockets of the platform section 13 of the base structure 12 as shown in FIG. 2.

Referring now to FIG. 4, the canopy top section 28 is shown in cross-sectional view. The canopy top section 28 is formed by using a plurality of pieces of "thin-walled" bendable tubing, for example, tubing 29, attaching the ends of the tubing to the sides of the canopy frame 24 (of FIG. 3) and forming an arched or bowed configuration across the top of canopy frame 24. At least two pieces of bendable tubing 29 should be used to provide a frame across which material can be stretched and then fixed to the sides of the canopy frame 24, resulting in the canopy design or a "bubble top" to the display unit 10 (shown in FIG. 1). Preferably, three to four pieces of bendable tubing 29 are used to provide a "ribbed" structure across which the material can be stretched to give the canopy structure 22 (of FIG. 1) a "ribbed" appearance. The length of the bendable tubing 29 many vary, depending upon the desired height of the canopy structure, with the preferred lengths being between 34 and 44 inches to provide a canopy top section 28 approximately 18 inches high.

The material used to cover the flexible tubing 29 and form the "bubble" or canopy design can be selected from a variety of fabrics, and is preferably a durable fabric having a certain degree of "stretch." The fabric is "stretched" across the flexible tubing 29 and affixed to the sides of the canopy frame 24, preferably by stapling to provide a canopy arrangement. The appearance of both the base structure 12 and canopy frame 24 of FIGS. 1 through 4 can also be enhanced by using laminated materials to cover any exposed wood surfaces.

Referring back to FIG. 1, positioned between the base structure 12 and canopy structure 22, are a plurality of vertical tubes 32*a*, 32*b*, 32*c* and 32*d* (not shown). As described earlier and shown in FIGS. 3 and 4, the base structure 12 and canopy structure 22 are each, respectively, provided with four metal sockets arranged in precise spatial relationships to receive the corresponding ends of vertical tubes 32*a*, 32*b*, 32*c* and 32*d*. The spatial relationship between the metal sockets on each structure, for example, sockets 16*a* and 16*b* on the base structure 12, as well as the alignment between corresponding sockets on the two structures, for example, 16*a* on the base structure and 25*a* on the canopy structure, must be precise; such precise relationships allow for alignment of the base and canopy structures when the vertical tubes are positioned between the structures during assembly.

The details relating to vertical tubes 32*a*, 32*b* and 32*c* of FIG. 1 and 32*d* (not shown) are shown in FIGS. 5 through 8. As can be seen in FIG. 5, the tube, referred to generally by the reference number 32, is square, preferably one inch on each side, and hollow. As shown in FIG. 6, tube 32 is provided with vertical slots 33 on two adjacent faces for placement of the shelf mounting brackets. Tube 32 is approximately 60 to 75 inches in height, with the vertical slots 33 occurring at regular intervals along the entire length of tube 32. Alternatively, the vertical slots 33 may begin a certain distance, preferably two to twelve inches, from one or both ends of tube 32, providing ends without slots.

FIGS. 7 and 8 show specific features of vertical tubes 32*a* and 32*b*, respectively. Referring now to FIG. 7, a third face 34 of vertical tube 32*a* is further provided with a strip of extruded plastic or "cladding" 35*a*, extending vertically along its entire length and terminating approximately one inch from the ends of tube 32*a* to allow for placement of tube 32*a* in the metal socket. As also illustrated in FIG. 7, the cladding 35*a* is further provided with a vertical slot 36*a* which extends the full length of cladding 35*a* for receipt of pegboard 42*a*. The remaining face 37*a* of vertical tube 32*a* is preferably solid along almost its entire length, except for a hole 38*a* approximately two inches from each end. Hole 38*a* is drilled in face 37*a*, through to the opposite slotted face 33*a* (not shown), for positioning of a tie-rod which acts as support for the backing material and anchoring means for the display unit.

Vertical tube 32*b* has the same features as vertical tube 32*a* except that, as shown in FIG. 8, the locations of the cladding and black face are switched. Thus, for vertical tube 32*b*, the third face 34*b* is blank with hole 38*b* drilled approximately two inches from each end and extending through to the opposite slotted face 33*b* (not shown) and the fourth face 37*b* is provided with cladding 35*b* with vertical slot 36*b*. In this way, when the display unit is assembled in the manner set forth below, vertical tubes 32*a* and 32*b* can be positioned so that the faces with cladding are aligned and the pegboard 42*a* can be placed between tubes 32*a* and 32*b* in the slots of the cladding. For the same reasons, and others that will be described below, vertical tube 32*c* is identical to vertical tube 32*a* and vertical tube 32*d* is identical to vertical tube 32*b*.

The arrangement and orientation of vertical tubes 32*a*, 33*b*, 32*c* and 32*d* can be better understood by referring to FIGS. 2, 9, 10 and 11. FIG. 2 shows the fully constructed base structure 12; FIG. 9 is a cross-sectional top view of the partially assembled display unit 12, vertical tubes 32*a*, 32*b*, 32*c* and 32*d* and lower tie rods 39; FIG. 10 is a sectional underside view of a corner of FIG. 9, after assembly; and FIG. 10*a* is a sectional view of FIG. 10 across the line A—A.

Once the base structure 12 of FIG. 2 is constructed, the metal sockets 16*a*, 16*b*, 16*c* and 16*d* are available for receipt of the vertical tubes, namely 32*a*, 32*b*, 32*c* and 32*d* of FIGS. 7 and 8. Since the metal sockets 16*a*, 16*b*, 16*c* and 16*d* have been specifically sized to hold vertical tubes 32*a*, 32*b*, 32*c* and 32*d*, the tubes are placed by simply inserting one end of each tube 32a, 32b, 32c and 32d in the corresponding metal sockets 16a, 16b, 16c and 16d, respectively. As is shown in FIG. 9, the vertical tubes are positioned so that the cladded faces of tubes 32a and 32b are directed toward each other, the cladded faces of tubes 32c and 32d are directed toward each other, the blank faces of tubes 32a and 32d are directed toward each other and the blank faces of tubes 32b and 32c are directed toward each other. The slotted faces of all tubes 32a, 32b, 32c and 32d are oriented toward the exterior of the display unit.

After the vertical tubes are positioned as described above, the tubes must be stabilized to prevent their movement when the backing material and canopy structure are put into place. As explained earlier, the blank faces of vertical tubes 32a, 32b, 32c and 32d are provided with holes approximately two inches from each of their respective ends. After placement of the vertical tubes in the metal sockets so that the blank faces of vertical tubes 32a and 32d and vertical tubes 32b and 32c are directed toward each other, respectively, the holes of tubes 32a and 32d and tubes 32b and 32c, respectively, are aligned with each other. The rods are then placed between tubes 32a and 32d and tubes 32b and 32c in the holes at both the upper and lower ends of the tubes to hold the vertical tubes somewhat stationary.

Thus, at least four tie rods (generally referred to as reference number 39) are used to stabilize the vertical tubes. In FIG. 9, lower tie rods 39, located between vertical tubes 32a and 32d and vertical tubes 32b and 32c, are shown. As can be seen, the lower tie rods 39 have sufficient length to extend between the vertical tubes and out through the opposite slotted faces of the tubes approximately one or two inches. For example, as shown in FIG. 9, lower tie rod 39 is located between vertical tubes 32a and 32d, and extends the full distance between those tubes and out through the opposite slotted faces of tubes 32a and 32d, respectively, approximately one to two inches. Another tie rod 39 is positioned the same way in the upper holes between tubes 32a and 32d, and two tie rods 39 are positioned in the same way between tubes 32b and 32c, in the upper and lower holes, respectively. The ends of each tie rod 39 are further provided with screw surfaces to allow for receipt of nuts to fasten the tie rods in place.

Once the tie rods are in place, the pieces of backing material 42a, 42b, 42c and 42d, shown generally in FIG. 1, can be positioned between the vertical tubes 32a, 32b, 32c and 32d. Pieces of backing material 42a and 42c are shown in phantom in FIG. 9.

As can be seen in FIG. 1, the pieces of backing material 42a and 2b, 42c and 42d (not shown), have the dimensions required to fill the space between two consecutively placed pieces of vertical tubing, for example, backing material 42a fills the space between vertical tubing 32a and 32b. Preferably, the pieces of backing material 42a and 42b, 42c and 42d are made from pegboard approximately one-quarter of an inch in thickness because that type of material provides a means of support for the display unit which is lightweight yet durable.

In addition, two of the pieces of backing material, namely backing material 42b and 42d, which will be placed between vertical tubes 32b and 32c and vertical tubes 32a and 32d, respectively, are further provided with wooden or metal cleats for hanging the pieces of backing material 42b and 42d on tie rods 39. As shown in FIG. 10a, cleat 48 is a modified L-structure, made of metal or wood, extending the width of the backing material 42b and 42d, at positions which allow the cleats 48 to hook onto tie rods 39 when the pieces of backing material 42b and 42d are placed on the display unit. Thus, tie rods 39 not only stabilize the vertical tubes, but also provide a means for positioning the backing material.

FIG. 10 provides an exploded view of a section of the partially assembled display unit of FIG. 9, namely the corner occupied by vertical tubing 32a. As can be seen in FIG. 10, the two exterior faces of tubing are provided with slots 33 for placement of metal shelf brackets 44 (shown in phantom). One interior face of vertical tubing 32a is provided with cladding 35a having a slot 36a for receipt of pegboard 42a; the other interior face is provided with holes for tie rods 39. As shown in FIGS. 9 and 10, after the vertical tubes are all in place and tie rods 39 installed, the pieces of pegboard are installed as follows: pegboard 42a is placed between vertical tubes 32a and 32b by inserting the pegboard into slots 35a and 35b from above and sliding the pegboard down until the base of the pegboard rests on the base structure. Pegboard 42c is installed between vertical tubes 32c and 32d in the same way. Pegboard 42d is installed between vertical tubes 32a and 32d by hooking cleats 48 over tie rods 39; pegboard 42b is positioned between vertical tubes 32b and 32c in the same way. After the pieces of backing material are installed, the canopy structure of FIGS. 3 and 4 can be positioned by mating the top ends of vertical tubes 32a, 32b, 32c and 32d with metal sockets 25a, 25b, 25c and 25d, respectively.

To complete the display unit of FIG. 1, a plurality of metal shelving brackets 44 and shelves 46, as shown in FIGS. 1 and 11, are needed. Once the structural elements of display unit 10 are assembled, the metal shelf brackets 44 are mounted, at the desired intervals, by the well-known "hook and slot" method, that is, the hooked ends of the shelf brackets 44 are inserted into the slots on vertical tubing 32. The shelves 46 are then mounted on the brackets 44, providing a display unit 10 which is attractive in appearance once fully assembled.

An option shown in FIG. 1 is the inclusion of exterior vertical tubing 50a, 50b, 50c and 50d (not shown) on the display unit 10. Like the interior vertical tubing 32a, 32b, 32c and 32d (not shown), exterior vertical tubing 50a, 50b, 50c and 50d is preferably 1 inch by 1 inch and has a height ranging from 60 to 75 inches, depending upon the height of the interior vertical tubing. However, the exterior vertical tubing 50a, 50b, 50c and 50d need not be slotted or provided with cladding but, rather, may have four solid faces to provide an overall structure which is attractive in appearance. If exterior vertical tubing 50a, 50b, 50c and 50d are used, then the base structure 12 and canopy structure 22 are further provided with three-eighths inch buttons on the exterior corners thereof to allow for placement of the exterior vertical tubing 50a, 50b, 50c and 50d when the display unit 10 is assembled.

After the various components of the display unit 10 are either constructed or collected according to specifications, then the display unit 10 of FIG. 1 can be shipped unassembled to the end-user, usually a retail store. As explained above, the display unit of the present invention is assembled as follows: the base structure is placed in the desired location in the retail store, which, for the display unit shown in FIG. 1, would be the end-of-the-aisle; the pieces of vertical tubing 32a, 32b, 32c and 32d are inserted in the respective metal sockets 16*a*, 16*b*, 16*c* and 16*d* in the base structure, with the adjacent slotted faces on each tube positioned toward the exterior of the unit, the cladded faces of adjacent vertical tubes 32*a* and 32*b* and adjacent vertical tubes 32*c* and 32*d* directed toward each other and the blank faces of adjacent vertical tubes 32*a* and 32*d* and adjacent vertical tubes 32*b* and 32*c* directed toward each other; the tie rods 39 are installed between vertical tubes 32*a* and 32*d* and vertical tubes 32*b* and 32*c*, respectively, in both the top and bottom holes; the pieces of backing material or pegboard 42*a* and 42*c* are inserted into the slots on the cladding of the vertical tubes 32*a* and 32*b* and vertical tubes 32*c* and 32*d* from above and slid down until the base of each piece of pegboard rests on the base structure; the pieces of backing material or pegboard 42*d* and 42*b*, with cleats, are installed between vertical tubes 32*a* and 32*d* and vertical tubes 32*b* and 32*c*, respectively, by hooking the top and bottom cleats of each pegboard on the respective top and bottom tie rods 39 between the respective vertical tubes; the canopy structure is then placed on top of the support column formed by the pieces of vertical tubing and pegboard with the metal sockets of the canopy structure mating with the top ends of the vertical tubing; the display unit is further stabilized by placing metal nuts on the end of each tie rod 39 and tightening the same; the metal shelf brackets are then installed in the slotted faces of the vertical tubes; the shelves are then placed on the metal shelf brackets; and finally, the merchandise to be displayed is placed on the shelves. Optionally, exterior vertical tubes may also be installed after placement of the canopy section on the support column. All of the above can be assembled without any tools required.

As also stated earlier, the display unit of the present invention has been described in terms of an end-of-the-aisle unit which provides three sides on which shelves may be mounted and merchandise displayed. Another embodiment of the present invention is the island unit, namely a unit which stands alone and provides four sides on which shelves may be mounted and merchandise displayed. If an island unit is desired, then the base structure 12 of FIG. 2 and the canopy structure 22 of FIG. 3 must be modified. The placement of the metal sockets in FIGS. 2 and 3 respectively provide a display unit 10 which, when assembled, has an interior support column which is offset from the center of the unit. To provide an island unit, the metal sockets on the base and canopy structures would need to be positioned in the center of the base and canopy structures. When the metal sockets are so positioned and the display unit assembled, a central support column is formed. With the support column in the center, shelf brackets and shelving may be installed on all four sides providing four sides on which the merchandise can be displayed.

Other options to aid is permanently or temporarily stabilizing the vertical tubes during assembly are probably available. For example, one or more tie rods could be used between all adjacent vertical tubes at various heights, with the corresponding pegboards provided with cleats or other hooking or latching means at corresponding heights, to aid in permanently stabilizing the display unit. Or, cladding may be used on both interior faces and the vertical tubes permanently stabilized by other means.

For temporary stability during assembly, assembly gages may be used. The assembly gages typically have hooking means similar to the shelf brackets and a bar between the hooking means equal in length to the distance between any two adjacent vertical tubes. Once the vertical tubes are positioned in the metal sockets, the assembly gages are hooked up to the exterior faces of any two adjacent vertical tubes to maintain the tubes in a stationary position. After the pegboard material and canopy structure are in place, the temporary assembly gages are simply removed, and the brackets and shelving units can then be put in place.

It will be understood by those skilled in the art that, while this invention has been described with reference to preferred embodiments, various changes may be made without departing from the scope of the invention. Therefore, it is intended that the invention not be limited to the particular embodiments disclosed as the best modes contemplated for carrying out this invention, but that the invention will include all embodiments falling within the scope of the claims that follow.

What is claimed is:

1. A merchandise display unit for use in retail stores which is easy to assemble comprising a base structure, a canopy structure and a plurality of slotted vertical tubes positioned between said base and canopy structures, said base structure having a plurality of metal sockets installed therein in precise spatial relationship to each other, said canopy structure having a plurality of corresponding metal sockets installed therein in the same precise spatial relationships, said metal sockets being positioned to allow for vertical alignment of said base and canopy structures when the respective ends of the slotted vertical tubes are inserted into the metal sockets of the base structure and the corresponding metal sockets of the canopy structure.

2. The merchandise display unit of claim 1, wherein the number of metal sockets installed in the base and canopy structures, respectively, is four, and correspondingly, four slotted vertical tubes are positioned between the base and canopy structures by inserting the slotted vertical tubes in the corresponding metal sockets of the base and canopy structures to form a display unit having a support column of square or rectangular dimensions.

3. The display unit of claim 2, wherein the metal sockets on both the base and canopy structures are positioned in the center of said base and canopy structures so that when the slotted vertical tubes are inserted in the corresponding metal sockets, a display unit having a central column and four sides for displaying merchandise is provided.

4. The display unit of claim 2, wherein the metal sockets on both the base and canopy structures are positioned to one side of said base and canopy structures so that when the slotted vertical tubes are inserted in the corresponding metal sockets, a display unit having an offset column and three sides for displaying merchandise is provided.

5. The display unit of claim 3, wherein each slotted vertical tube has two adjacent exterior faces which are slotted for insertion of metal shelf brackets, said metal shelf brackets providing support means for the placement of pieces of glass shelving.

6. The display unit of claim 5, wherein each slotted vertical tube has at least one interior face on which is provided plastic cladding with a vertical slot for receipt and placement of backing material as part of the support column.

7. The display unit of claim 5, wherein each slotted vertical tube has at least one blank face having holes at both ends for placement and receipt of tie rods between any two adjacent vertical tubes, said tie rods providing means for stabilizing said display unit and means for positioning backing material as part of the support column.

8. The display unit of claim 5, wherein said slotted vertical tubes each have an interior face with cladding and an interior face which is blank with holes, said cladded face and blank face alternating on each adjacent vertical tube so that the cladded face of one tube is directed toward the cladded face of an adjacent tube and the remaining blank face is directed toward the blank face of the other adjacent tube.

9. The display unit of claim 5, wherein the display unit is provided with additional vertical tubes on the exterior corners of the canopy and base structures.

10. The display unit of claim 5, wherein said canopy structure is comprised of ribbed support members and a durable material stretched across said members to form a bubble-type canopy configuration.

11. The display unit of claim 4, wherein each slotted vertical tube has two adjacent exterior faces which are slotted for insertion of metal shelf brackets, said metal shelf brackets providing support means for the placement of pieces of glass shelving.

12. The display unit of claim 4, wherein each slotted vertical tube has at least one interior face on which is provided plastic cladding with a vertical slot for receipt and placement of backing material as part of the support column.

13. The display unit of claim 4, wherein each slotted vertical tube has at least one blank face having holes at both ends for placement and receipt of tie rods between any two adjacent vertical tubes, said tie rods providing means for stabilizing said display unit and means for positioning backing material as part of the support column.

14. The display unit of claim 4, wherein said slotted vertical tubes each have an interior face with cladding and an interior face which is blank with holes, said cladded face and blank face alternating on each adjacent vertical tube so that the cladded face of one tube is directed toward the cladded face of an adjacent tube and the remaining blank face is directed toward the blank face of the other adjacent tube.

15. The display unit of claim 4, wherein the display unit is provided with additional vertical tubes on the exterior corners of the canopy and base structures.

16. The display unit of claim 4, wherein said canopy structure is comprised of ribbed support members and a durable material stretched across said members to form a bubble-type canopy configuration.

* * * * *